US011248754B2

(12) United States Patent
Li et al.

(10) Patent No.: US 11,248,754 B2
(45) Date of Patent: Feb. 15, 2022

(54) LIGHT TUBE APPARATUS

(71) Applicant: XIAMEN LEEDARSON LIGHTING CO., LTD, Fujian (CN)

(72) Inventors: Guochao Li, Fujian (CN); Yongjun Bao, Fujian (CN); Dejuan Liang, Fujian (CN)

(73) Assignee: XIAMEN LEEDARSON LIGHTING CO., LTD, Fujian (CN)

( * ) Notice: Subject to any disclaimer, the term of this patent is extended or adjusted under 35 U.S.C. 154(b) by 0 days.

(21) Appl. No.: 17/000,160

(22) Filed: Aug. 21, 2020

(65) Prior Publication Data

US 2021/0054974 A1 Feb. 25, 2021

(30) Foreign Application Priority Data

Aug. 23, 2019 (CN) ..... 201921385181.9

(51) Int. Cl.

| | |
|---|---|
| ***F21K 9/278*** | (2016.01) |
| ***F21V 23/00*** | (2015.01) |
| ***F21V 17/10*** | (2006.01) |
| ***F21V 23/04*** | (2006.01) |
| ***F21Y 115/10*** | (2016.01) |

(52) U.S. Cl.

CPC ..... *F21K 9/278* (2016.08); *F21V 17/104* (2013.01); *F21V 23/006* (2013.01); *F21V 23/04* (2013.01); *F21Y 2115/10* (2016.08)

(58) Field of Classification Search

CPC ..... F21K 9/278; F21K 9/272; F21V 23/00; F21V 17/104; F21V 23/04; F21Y 2115/10; F21Y 2103/10; F21S 4/20; F21S 4/28; F21S 4/00

See application file for complete search history.

(56) References Cited

U.S. PATENT DOCUMENTS

| | | | | |
|---|---|---|---|---|
| 7,592,561 | B2 * | 9/2009 | Nishiyama | H01H 13/023 200/313 |
| 8,523,394 | B2 * | 9/2013 | Simon | H05B 45/3578 362/249.05 |
| 9,644,828 | B1 * | 5/2017 | May | F21S 8/04 |
| 9,989,200 | B2 * | 6/2018 | Yingchun | F21V 23/06 |
| 10,060,603 | B2 * | 8/2018 | Honold | F21V 23/02 |
| 10,145,516 | B2 * | 12/2018 | Thiel | F21K 9/278 |
| 2012/0113633 | A1 * | 5/2012 | Bowen | F21V 23/005 362/235 |
| 2015/0176770 | A1 * | 6/2015 | Wilcox | F21K 9/272 362/224 |
| 2017/0244148 | A1 * | 8/2017 | Ge | F21K 9/278 |
| 2018/0112836 | A1 * | 4/2018 | Rieder | F21K 9/272 |

* cited by examiner

*Primary Examiner* — Peggy A Neils
(74) *Attorney, Agent, or Firm* — Chun-Ming Shih; Lanway IPR Services

(57) ABSTRACT

A light tube apparatus includes a light passing tube, a light strip, first cap end, a second cap end, a driver circuit board and a manual switch. The light passing tube are connected with the first cap end and the second cap end on opposite sides of the light passing tube. The manual switch is a fixed to the first cap end. The driver circuit board is at least partly enclosed by the first cap end. The manual switch has a switch sheath and a sliding switch. When a user moves the switch sheath, the sliding switch is moved by the switch sheath to change a position of the sliding switch for changing an operation parameter of the driver circuit.

18 Claims, 9 Drawing Sheets

LIGHT TUBE APPARATUS

FIELD

The present invention is related to a light tube apparatus, and more particularly related to a light tube apparatus with a configuration function.

BACKGROUND

The time when the darkness is being lighten up by the light, human have noticed the need of lighting up this planet. Light has become one of the necessities we live with through the day and the night. During the darkness after sunset, there is no natural light, and human have been finding ways to light up the darkness with artificial light. From a torch, candles to the light we have nowadays, the use of light have been changed through decades and the development of lighting continues on.

Early human found the control of fire which is a turning point of the human history. Fire provides light to bright up the darkness that have allowed human activities to continue into the darker and colder hour of the hour after sunset. Fire gives human beings the first form of light and heat to cook food, make tools, have heat to live through cold winter and lighting to see in the dark.

Lighting is now not to be limited just for providing the light we need, but it is also for setting up the mood and atmosphere being created for an area. Proper lighting for an area needs a good combination of daylight conditions and artificial lights. There are many ways to improve lighting in a better cost and energy saving. LED lighting, a solid-state lamp that uses light-emitting diodes as the source of light, is a solution when it comes to energy-efficient lighting. LED lighting provides lower cost, energy saving and longer life span.

The major use of the light emitting diodes is for illumination. The light emitting diodes is recently used in light bulb, light strip or light tube for a longer lifetime and a lower energy consumption of the light. The light emitting diodes shows a new type of illumination which brings more convenience to our lives. Nowadays, light emitting diode light may be often seen in the market with various forms and affordable prices.

After the invention of LEDs, the neon indicator and incandescent lamps are gradually replaced. However, the cost of initial commercial LEDs was extremely high, making them rare to be applied for practical use. Also, LEDs only illuminated red light at early stage. The brightness of the light only could be used as indicator for it was too dark to illuminate an area. Unlike modern LEDs which are bound in transparent plastic cases, LEDs in early stage were packed in metal cases.

In 1878, Thomas Edison tried to make a usable light bulb after experimenting different materials. In November 1879, Edison filed a patent for an electric lamp with a carbon filament and keep testing to find the perfect filament for his light bulb. The highest melting point of any chemical element, tungsten, was known by Edison to be an excellent material for light bulb filaments, but the machinery needed to produce super-fine tungsten wire was not available in the late 19th century. Tungsten is still the primary material used in incandescent bulb filaments today.

Early candles were made in China in about 200 BC from whale fat and rice paper wick. They were made from other materials through time, like tallow, spermaceti, colza oil and beeswax until the discovery of paraffin wax which made production of candles cheap and affordable to everyone. Wick was also improved over time that made from paper, cotton, hemp and flax with different times and ways of burning. Although not a major light source now, candles are still here as decorative items and a light source in emergency situations. They are used for celebrations such as birthdays, religious rituals, for making atmosphere and as a decor.

Illumination has been improved throughout the times. Even now, the lighting device we used today are still being improved. From the illumination of the sun to the time when human can control fire for providing illumination which changed human history, we have been improving the lighting source for a better efficiency and sense. From the invention of candle, gas lamp, electric carbon arc lamp, kerosene lamp, light bulb, fluorescent lamp to LED lamp, the improvement of illumination shows the necessity of light in human lives.

There are various types of lighting apparatuses. When cost and light efficiency of LED have shown great effect compared with traditional lighting devices, people look for even better light output. It is important to recognize factors that can bring more satisfaction and light quality and flexibility.

Light tubes have lots of technology advancement too. In past, fluorescent light tubes are widely used but they bring certain environment pollution for material used. LED devices are used in LED tubes and there are many details to be improved to provide a better light tube.

One aspect is to provide convenience on settings of the light tube. It is beneficial to design a light tube that is easily to be configured while keeping its assembling easier and under low cost.

SUMMARY

In some embodiments, a light tube apparatus includes a light passing tube, a light strip, first cap end, a second cap end, a driver circuit board and a manual switch.

The light passing tube has a light passing cover for a light of the light strip to pass through. In some embodiments, the light passing cover is a 360-degree light passing tube, completely allowing the light to pass through. In some other embodiments, the light passing cover only occupies a portion of the light passing tube. In other words, a portion of surface of the light passing tube does not allow the light to pass through.

The light passing tube are connected with the first cap end and the second cap end on opposite sides of the light passing tube.

The light passing cover may have a diffusion layer for diffusing the light of the light strip. In some embodiments, the light strip has a substrate mounted with multiple LED modules. Each LED module has a diffusing lens for diffusing light of the LED module, too.

Such design provides a wide angle of the light, even the LED modules are disposed on an elongated substrate bar.

To be installed to a traditional light tube socket, there are two copper pins respectively disposed on the first cap end and the second cap end for installing to corresponding slots of the light tube socket.

There are several types of ways for supplying power to the light tube, depending on the design of the light tube socket. In some embodiment, to be compatible with traditional light tubes, the driver circuit board has a driver circuit that needs to convert a high frequency voltage to a working voltage first when generating a driving current supplied to the LED modules of the light strip.

There may be multiple types of the LED modules, e.g. LED modules with different color temperatures, different colors, or different color rendering index. The driver circuit on the driver circuit board controls supplying of the driving currents to the different types of LED modules to mix a desired optical parameter.

However, it is a critical issue to inform the driver circuit how to adjust the optical parameter. Therefore, the manual switch is a fixed to the first cap end. The driver circuit board is at least partly enclosed by the first cap end. In some embodiments, the driver circuit board may be completely concealed by the first cap end. In some other embodiments, a portion of the driver circuit board may be longer than the width of the first cap end and extend into the light passing tube.

The light strip may be connected to the driver circuit board so as to be fixed at a desired position inside the light passing tube.

The manual switch has a switch sheath and a sliding switch. The sliding switch is mounted on the driver circuit board. The first cap end has a switch opening. The switch sheath is inserted through the switch opening to connect to the sliding switch. When a user moves the switch sheath, the sliding switch is moved by the switch sheath to change a position of the sliding switch for changing an operation parameter of the driver circuit.

For example, the sliding switch may be moved among several options corresponding to different color temperatures. The driver circuit detects the position of the sliding switch to determine current ratio to be applied on different types of LED modules of the light strip to render a corresponding color temperature.

Similarly, the sliding switch may be used to change a color, a light intensity, a color rendering index or other parameter of the light tube apparatus.

In other words, the operation parameter may correspond to one or multiple sets of variables that may be used for adjusting a setting of the driver circuit, not only limited to optical parameters. For example, an emergency or power saving mode may be set via the sliding switch.

In some embodiments, the first cap end has a guiding groove for the driver circuit board to move along the guiding groove to a predetermined assembled position to align the sliding switch to align with the switch opening to connect to the switch sheath.

In some embodiments, the first cap end has a stop rib for stopping movement of the driver circuit board along the sliding groove when the driver circuit board is inserted to reach the predetermined assembled position.

In some embodiments, the switch sheath has a receiver groove for enclosing a handle inserted into the receiver groove.

In some embodiments, the switch sheath has a first wing plate and a second wing plate on opposite sides of the switch sheath. When the switch sheath is moved along the switch opening, the first wing plate and the second wing plate keeps the switch opening sealed.

In some embodiments, the first wing plate and the second wing plate are positioned at different heights with respect to a switch top of the switch sheath.

In some embodiments, the switch sheath has an elastic reverse hook deformed when the switch sheath is inserted into the switch opening. A shape of the reverse hook is elastically recovered when the switch sheath is already plugged to connect to the sliding switch.

In some embodiments, the switch sheath has a first bottom wall and a second bottom wall arranged on opposite sides of the switch sheath. The first bottom wall, the second bottom wall and the reverse hook together enclose the sliding switch to move the sliding switch.

In some embodiments, there are multiple types of the switch sheath to be selected to inserted into the switch opening. Each type of the switch sheath corresponds to an operation status of the light strip.

In some embodiments, the driver circuit detects the type of the inserted switch sheath to determine an optical parameter of the light strip.

In some embodiments, the optical parameter may include a mixed color temperature rendered by multiple LED modules of the light strip.

In some embodiments, the switch sheath has a function circuit electrically connected to the driver circuit to expand a function of the switch circuit.

In some embodiments, the function circuit may include a wireless circuit for routing a message received by communicating with an external device.

In some embodiments, the function circuit may include an antenna electrically connected to the driver circuit.

In some embodiments, the switch sheath has a switch top to be touched by a user to move the switch sheath.

In some embodiments, the switch top has a sub-switch for selecting a working status to control the driver circuit.

In some embodiments, the sub-switch is a button.

In some embodiments, the first cap end has a rotating structure for rotating an angle of the switch sheath with respect to the driver circuit board.

In some embodiments, the second cap end has a supplemental switch for providing a supplemental control of the driver circuit.

In some embodiments, the switch sheath has a light indicator for indicating a working status assigned by the driver circuit.

DETAILED DESCRIPTION

Figure 1:
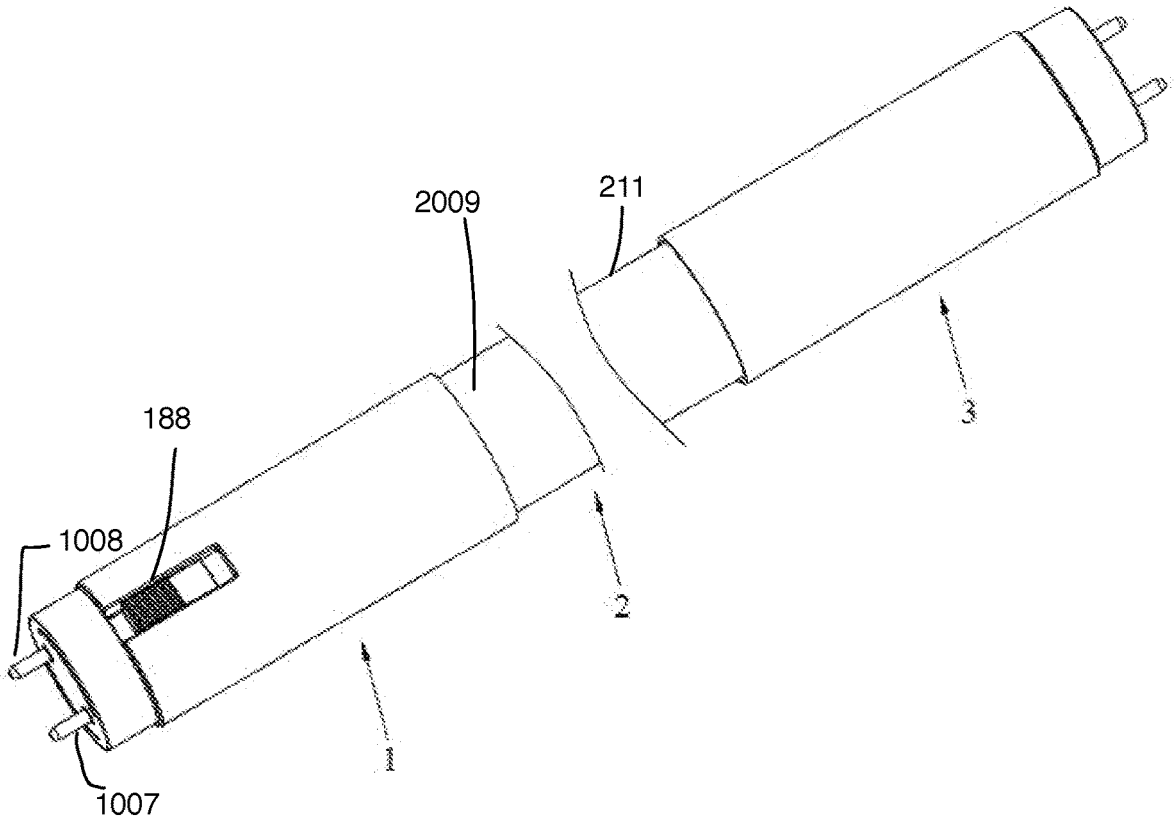
FIG. 1 illustrates an example of a light tube apparatus embodiment.

Please refer to FIG. 1, a light tube apparatus includes a light passing tube 2, a light strip, first cap end 1, a second cap end 3, a driver circuit board and a manual switch 188. The driver board and the light strip are enclosed by the light passing tube 2 and are illustrated in following disclosure and other drawings.

The light passing tube has a light passing cover for a light of the light strip to pass through. In some embodiments, the light passing cover is a 360-degree light passing tube, completely allowing the light to pass through. In some other embodiments, the light passing cover only occupies a portion of the light passing tube. In other words, a portion of surface of the light passing tube does not allow the light to pass through.

The light passing tube 2 are connected with the first cap end 1 and the second cap end 3 on opposite sides of the light passing tube 2.

The light passing cover may have a diffusion layer 211 for diffusing the light of the light strip. In some embodiments, the light strip has a substrate mounted with multiple LED modules. Each LED module has a diffusing lens for diffusing light of the LED module, too.

Figure 8:
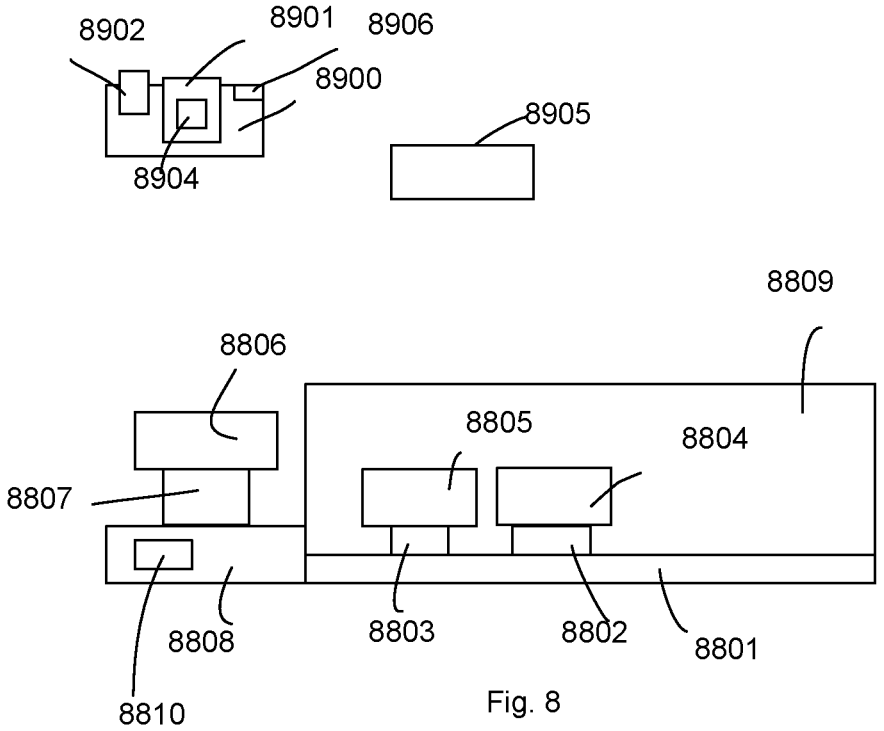
FIG. 8 shows an embodiment which has a replaceable switch sheath.

Please refer to FIG. 8. In FIG. 8, there are multiple type of LED modules 8802, 8803 in the light source plate 8801. The LED modules 8802, 8803 may have different color temperatures or other optical characteristics. There are diffusion lens 8804, 8805 disposed above the LED modules 8802, 8803 for diffusing light of the LED modules 8802, 8803.

The LED module 8802 may have multiple types of LED chips integrated as the LED module 8802. The different types of LED chips may be controlled separately by the driver circuit 8810 on the driver circuit board 8808.

There is a sliding switch 8807 connected to a switch sheath 8806 to be moved and changing an operation status of the driver circuit 8810 to generate different lights passing through the light passing cover 8809 of the light passing tube.

Such design provides a wide angle of the light, even the LED modules are disposed on an elongated substrate bar.

In FIG. 1, to be installed to a traditional light tube socket, there are two copper pins 1007, 1008 respectively disposed on the first cap end 1 and the second cap end for installing to corresponding slots of the light tube socket.

There are several types of ways for supplying power to the light tube, depending on the design of the light tube socket. In some embodiment, to be compatible with traditional light tubes, the driver circuit board has a driver circuit that needs to convert a high frequency voltage to a working voltage first when generating a driving current supplied to the LED modules of the light strip.

There may be multiple types of the LED modules, e.g. LED modules with different color temperatures, different colors, or different color rendering index. The driver circuit on the driver circuit board controls supplying of the driving currents to the different types of LED modules to mix a desired optical parameter.

However, it is a critical issue to inform the driver circuit how to adjust the optical parameter. Therefore, the manual switch is a fixed to the first cap end. The driver circuit board is at least partly enclosed by the first cap end. In some embodiments, the driver circuit board may be completely concealed by the first cap end. In some other embodiments, a portion of the driver circuit board may be longer than the width of the first cap end and extend into the light passing tube, e.g. to the position 2009 in FIG. 1.

The light strip may be connected to the driver circuit board so as to be fixed at a desired position inside the light passing tube.

Figure 2:
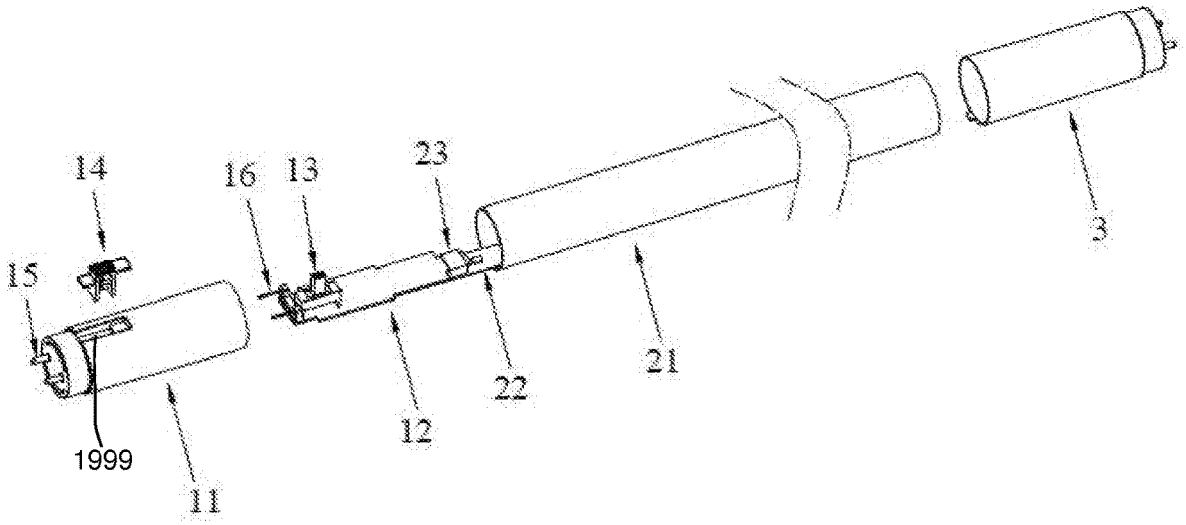
FIG. 2 illustrates an exploded view showing components used in the embodiment of FIG. 1.

In FIG. 2, the manual switch has a switch sheath 14 and a sliding switch 13. The copper pins 15 is used for connecting to an external power source. The sliding switch 13 is mounted on the driver circuit board 12. There are two conductive pins 16 to be inserted into or contact the copper pins 15 for receiving the external power source. The light strip 22 is electrically connected and controlled by the driver circuit on the driver circuit board 12. The light passing tube 21 encloses the light strip 22.

The first cap end 11 has a switch opening 1999. The switch sheath 14 is inserted through the switch opening 1999 to connect to the sliding switch 13. When a user moves the switch sheath 14, the sliding switch 13 is moved by the switch sheath 14 to change a position of the sliding switch 13 for changing an operation parameter of the driver circuit.

For example, the sliding switch may be moved among several options corresponding to different color temperatures. The driver circuit detects the position of the sliding switch to determine current ratio to be applied on different types of LED modules of the light strip to render a corresponding color temperature.

Similarly, the sliding switch may be used to change a color, a light intensity, a color rendering index or other parameter of the light tube apparatus.

In other words, the operation parameter may correspond to one or multiple sets of variables that may be used for adjusting a setting of the driver circuit, not only limited to optical parameters. For example, an emergency or power saving mode may be set via the sliding switch.

Figure 3:
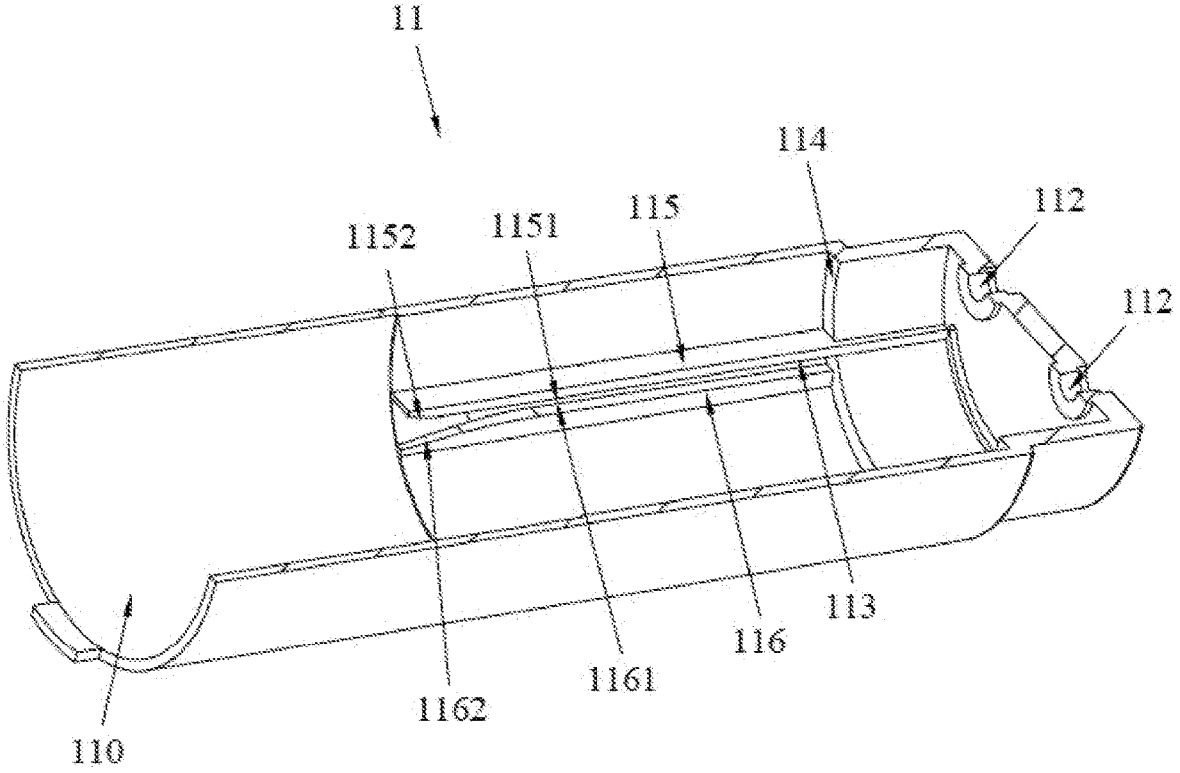
FIG. 3 illustrates a component structure of a cap end.

In FIG. 3, the first cap end 11 has an installation cavity 110. The first cap end 11 has a guiding groove 113 for the driver circuit board to move along the guiding groove 113 to a predetermined assembled position to align the sliding switch to align with the switch opening to connect to the switch sheath.

Specifically, there is a stop rib 114 for preventing the driver circuit board to move over a predetermined position. In the predetermined position, the conductive pins of the driver circuit board may be successfully inserted into the copper pins mentioned above via the two pin holes 112. The guiding groove 113 has two guiding entry points 1152, 1162, two guiding surfaces 1151, 1161 and two guiding blocks 115, 116.

In some embodiments, the first cap end has a stop rib 114 for stopping movement of the driver circuit board along the sliding groove 113 when the driver circuit board is inserted to reach the predetermined assembled position.

Figure 4:
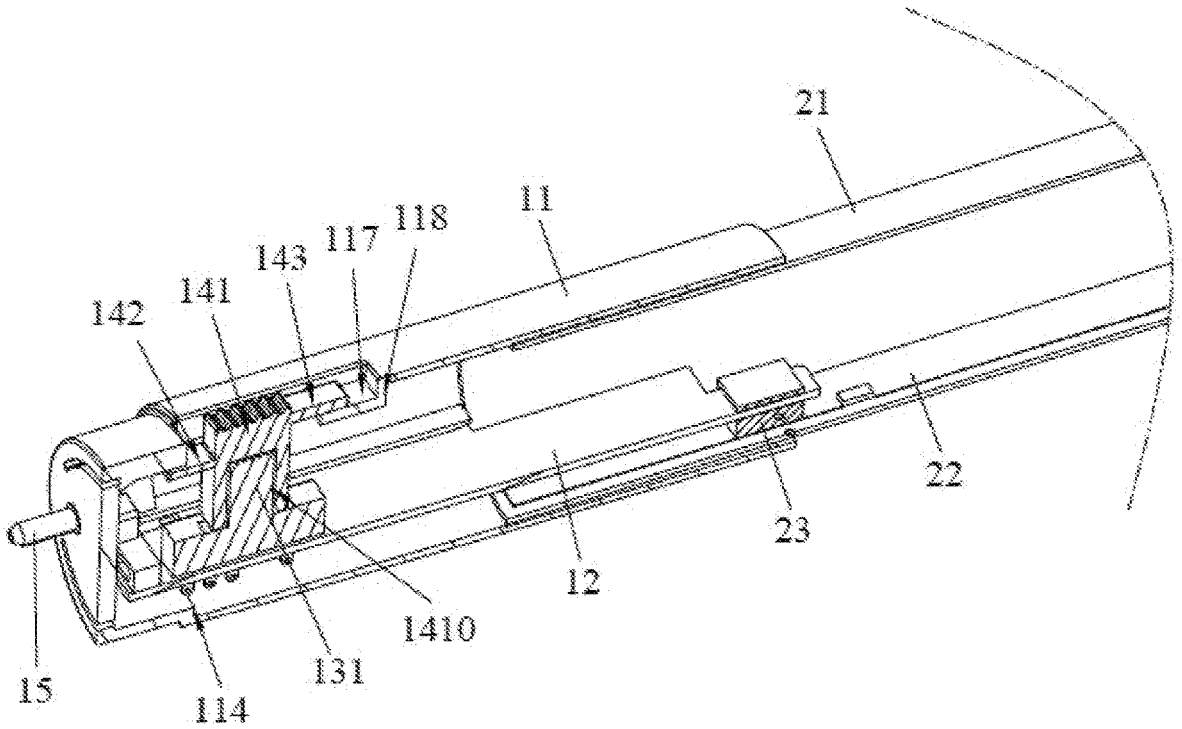
FIG. 4 illustrates a cross sectional view of a light tube section.

In FIG. 4, the switch sheath 141 has a receiver groove 1410 for enclosing a handle 131 inserted into the receiver groove 1410. The sliding switch is stopped when engaging the stop rib 114. The sliding switch is moved among different positions of the driver circuit board 12. Other same reference numerals refer to the same components mentioned above and are not repeated for brevity.

In some embodiments, the switch sheath 141 has a first wing plate 142 and a second wing plate 144 on opposite sides of the switch sheath. When the switch sheath 141 is moved along the switch opening, the first wing plate 141 and the second wing plate 142 keeps the switch opening sealed.

Figure 7:
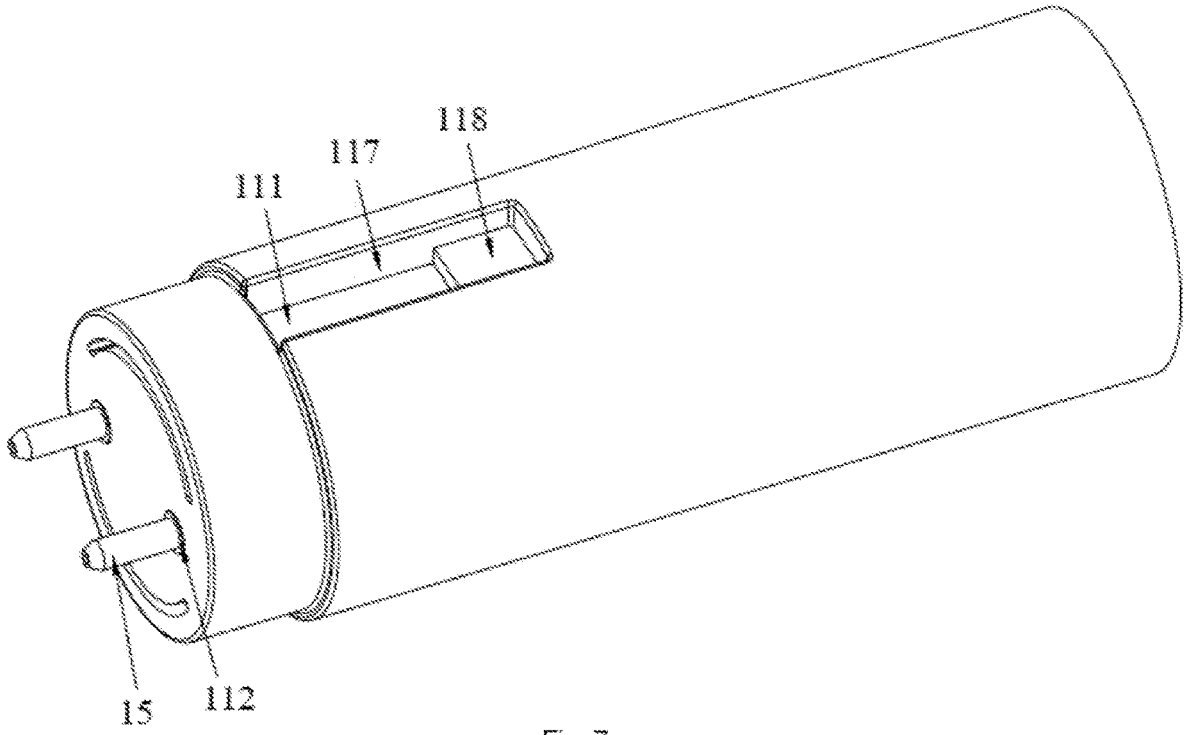
FIG. 7 illustrates a switch opening at a cap end.

Please also refer to FIG. 7 and FIG. 4. There is a lateral wall 117 and engaging block 118 disposed on the switch opening 111 for moving the switch sheath. The first wing plate 142 and the second wing plate 143 covers the switching opening 111 so that dust and water does not get into the first cap end to cause danger situation.

Figure 6:
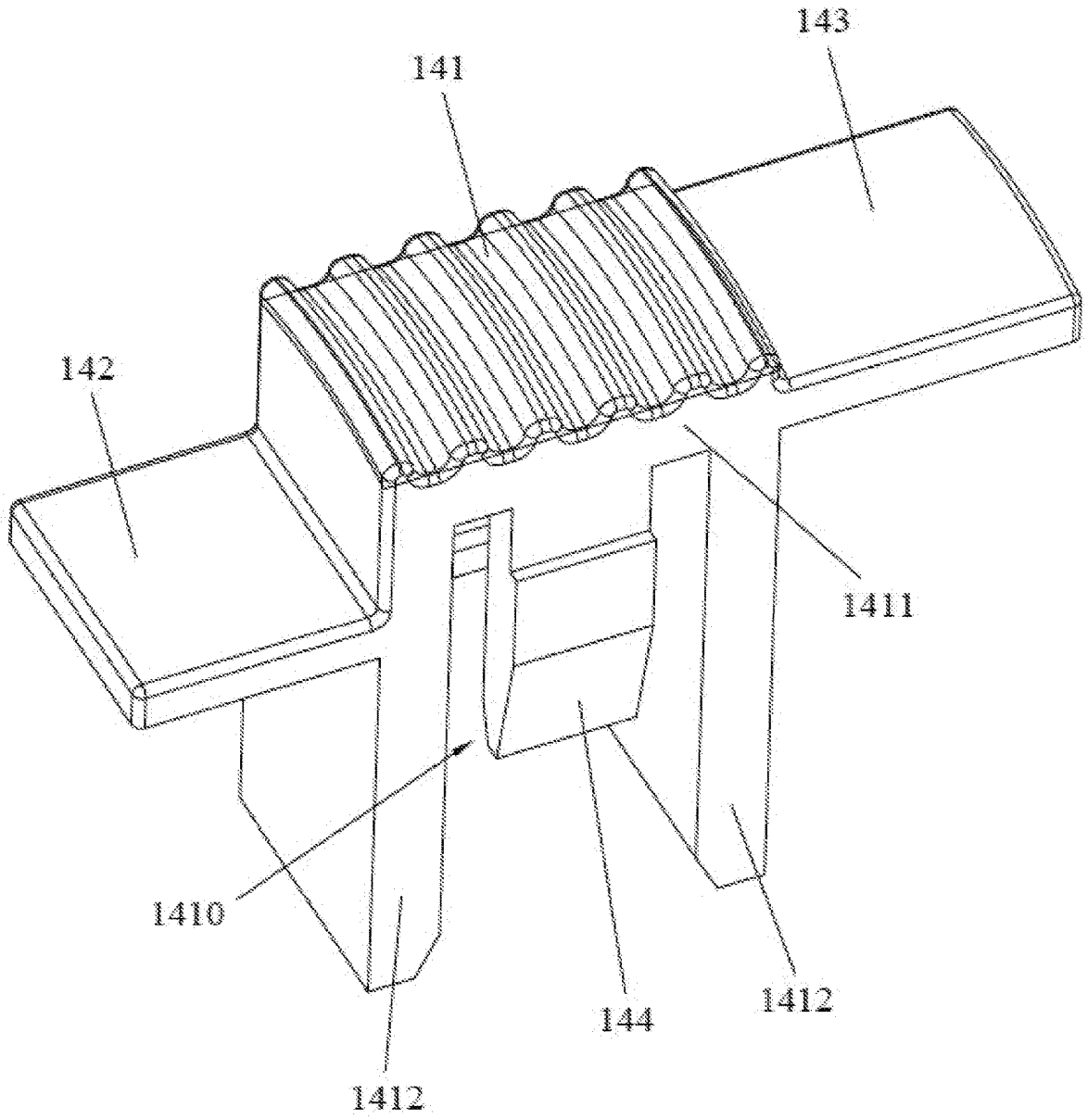
FIG. 6 illustrates a switch sheath example.

In FIG. 6, the first wing plate 142 and the second wing plate 143 are positioned at different heights with respect to a switch top 1411 of the switch sheath 141.

In FIG. 6, the switch sheath 141 has an elastic reverse hook 144 deformed when the switch sheath 141 is inserted into the switch opening. A shape of the reverse hook 1412 is elastically recovered when the switch sheath is already plugged to connect to the sliding switch.

In some embodiments, the switch sheath has a first bottom wall 1412 and a second bottom 1412 wall arranged on opposite sides of the switch sheath. The first bottom wall 1412, the second bottom wall 1412 and the reverse hook 144 together enclose the sliding switch in an enclosing space 1410 to move the sliding switch.

Figure 5:
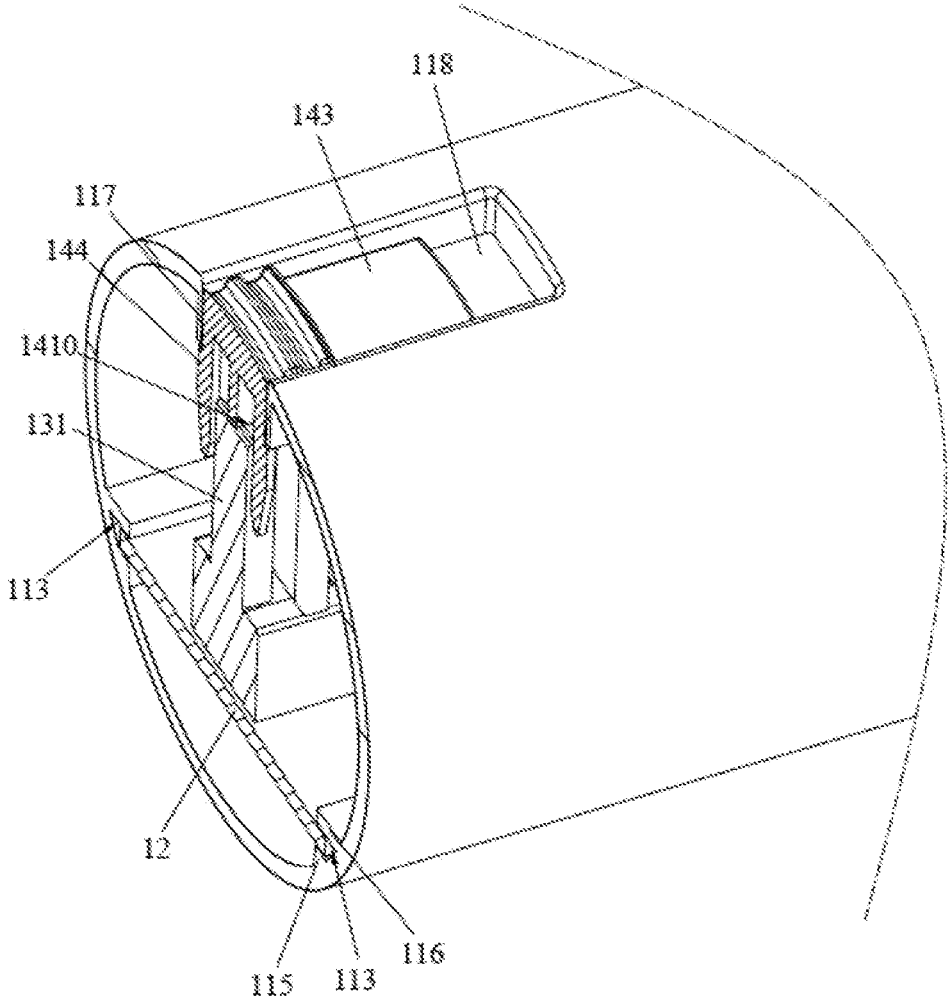
FIG. 5 illustrates another view of a cross-sectional view of a light tube section.

FIG. 5 shows another view for more clearly showing the example. In addition to the components mentioned above, there are limiting blocks 115, 116, enclosing plate 117 for providing a stable and reliable switch structure.

Figure 10:
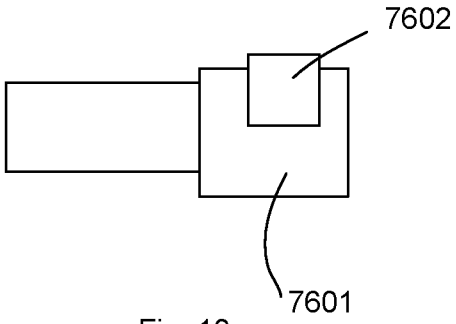
FIG. 10 shows a supplemental switch disposed on the second cap end.

In FIG. 10, there are multiple types of the switch sheath to be selected to inserted into the switch opening. Each type of the switch sheath corresponds to an operation status of the light strip. For example, in addition to use a default switch sheath 8806 mentioned above, another switch sheath 8900 may be selected for providing another function.

In some embodiments, the driver circuit detects the type of the inserted switch sheath to determine an optical parameter of the light strip.

In some embodiments, the optical parameter may include a mixed color temperature rendered by multiple LED modules of the light strip. For example, the switch sheath may include a resistor with a resistor value indicating which type of the switch sheath is currently inserted to the light tube apparatus.

In some embodiments, the switch sheath 8900 has a function circuit 8901 electrically connected to the driver circuit to expand a function of the switch circuit.

In some embodiments, the function circuit may include a wireless circuit 8904 for routing a message received by communicating with an external device 8905, e.g. via Wi-Fi, Bluetooth or other communication standard.

In some embodiments, the function circuit may include an antenna 8906 electrically connected to the driver circuit.

In some embodiments, the switch sheath has a switch top 8901 to be touched by a user to move the switch sheath.

In some embodiments, the switch top has a sub-switch for selecting a working status to control the driver circuit.

In some embodiments, the sub-switch is a button. For example, the switch top 8901 is integrated with a button.

Figure 9:
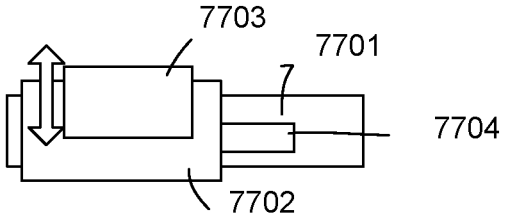
FIG. 9 shows a rotatable structure for rotating the switch sheath.

In FIG. 9, the first cap end 7701 has a rotating structure 7702 for rotating an angle of the switch sheath 7703 with respect to the driver circuit board 7704. The rotation may only have angle among 120 degrees instead of 360 degrees to keep the structure more stable while providing certain convenience for users to easily reach and touch the switch sheath.

In FIG. 10, the second cap end 7601 has a supplemental switch 7602 for providing a supplemental control of the driver circuit.

In FIG. 8, the switch sheath has a light indicator 8902 for indicating a working status assigned by the driver circuit.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings.

The embodiments were chosen and described in order to best explain the principles of the techniques and their practical applications. Others skilled in the art are thereby enabled to best utilize the techniques and various embodiments with various modifications as are suited to the particular use contemplated.

Although the disclosure and examples have been fully described with reference to the accompanying drawings, it is to be noted that various changes and modifications will become apparent to those skilled in the art. Such changes and modifications are to be understood as being included within the scope of the disclosure and examples as defined by the claims.

The invention claimed is:

1. A light tube apparatus, comprising:

a light passing tube;

a light strip enclosed by the light passing tube emitting a light through the light passing tube;

a first cap end and a second cap end fixed to two opposite ends of the light passing tube;

a driver circuit board comprising a driver circuit, the driver circuit board being at least partly enclosed by the first cap end; and a manual switch fixed to the first cap end, the manual switch having a switch sheath and a sliding switch, wherein the sliding switch is mounted on the driver circuit board, the first cap end has a switch opening, the switch sheath is inserted through the switch opening to connect to the sliding switch, when a user moves the switch sheath, the sliding switch is moved by the switch sheath to change a position of the sliding switch for changing an operation parameter of the driver circuit, wherein the switch sheath has a receiver groove for enclosing a handle inserted into the receiver groove, wherein the switch sheath has an elastic reverse hook deformed when the switch sheath is inserted into the switch opening and a shape of the reverse hook is elastically recovered when the switch sheath is already plugged to connect to the sliding switch.

2. The light tube apparatus of claim 1, wherein the first cap end has a guiding groove for the driver circuit board to move along the guiding groove to a predetermined assembled position to align the sliding switch to align with the switch opening to connect to the switch sheath.

3. The light tube apparatus of claim 2, wherein the first cap end has a stop rib for stopping movement of the driver circuit board along the sliding groove when the driver circuit board is inserted to reach the predetermined assembled position.

4. The light tube apparatus of claim 1, wherein the switch sheath has a first wing plate and a second wing plate on opposite sides of the switch sheath, when the switch sheath is moved along the switch opening, the first wing plate and the second wing plate keeps the switch opening sealed.

5. The light tube apparatus of claim 4, wherein the first wing plate and the second wing plate are positioned at different heights with respect to a switch top of the switch sheath.

6. The light tube apparatus of claim 1, wherein the switch sheath has a first bottom wall and a second bottom wall arranged on opposite sides of the switch sheath, the first bottom wall, the second bottom wall and the reverse hook together enclose the sliding switch to move the sliding switch.

7. The light tube apparatus of claim 1, wherein there are multiple types of the switch sheath to be selected to inserted into the switch opening, each type of the switch sheath corresponds to an operation status of the light strip.

8. The light tube apparatus of claim 7, wherein the driver circuit detects the type of the inserted switch sheath to determine an optical parameter of the light strip.

9. The light tube apparatus of claim 8, wherein the optical parameter comprises a mixed color temperature rendered by multiple LED modules of the light strip.

10. The light tube apparatus of claim 1, wherein the switch sheath has a function circuit electrically connected to the driver circuit to expand a function of the switch circuit.

11. The light tube apparatus of claim 10, wherein the function circuit comprises a wireless circuit for routing a message received by communicating with an external device.

12. The light tube apparatus of claim 10, wherein the function circuit comprises an antenna electrically connected to the driver circuit.

13. The light tube apparatus of claim 1, wherein the switch sheath has a switch top to be touched by a user to move the switch sheath.

14. The light tube apparatus of claim 13, wherein the switch top has a sub-switch for selecting a working status to control the driver circuit.

15. The light tube apparatus of claim 14, wherein the sub-switch is a button.

16. The light tube apparatus of claim 1, wherein the first cap end has a rotating structure for rotating an angle of the switch sheath with respect to the driver circuit board.

17. The light tube apparatus of claim 1, wherein the second cap end has a supplemental switch for providing a supplemental control of the driver circuit.

18. The light tube apparatus of claim 1, wherein the switch sheath has a light indicator for indicating a working status assigned by the driver circuit.

* * * * *